US005984296A

United States Patent [19]

Fricke et al.

[11] Patent Number: 5,984,296

[45] **Date of Patent: *Nov. 16, 1999**

[54] DEVICE FOR CYCLICALLY LIFTING AND LOWERING A LIFTING SUCKER IN A FEEDER OF A SHEET-PROCESSING MACHINE

[75] Inventors: Andreas Fricke, Eberbach; Jürgen Zeltner, Hirschberg, both of Germany

[73] Assignee: Heidelberger Druckmaschinen Aktiengesellschaft, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/671,800

[22] Filed: Jun. 24, 1996

[30] Foreign Application Priority Data

Jun. 23, 1995 [DE] Germany ..... 195 22 901

[51] Int. Cl.[6] ..... B65H 3/42

[52] U.S. Cl. ..... 271/93; 271/102; 271/107

[58] Field of Search ..... 271/91, 93, 102, 271/107, 14, 11, 106

[56] References Cited

U.S. PATENT DOCUMENTS

| | | | |
|---|---|---|---|
| 2,159,456 | 5/1939 | Spiess | 271/106 |
| 3,809,389 | 5/1974 | Wirz | 271/93 X |
| 4,589,649 | 5/1986 | Prescher | 271/107 |
| 4,940,221 | 7/1990 | Wirz et al. | 271/107 |
| 5,613,671 | 3/1997 | Fricke et al. | 271/107 X |

FOREIGN PATENT DOCUMENTS

| | | |
|---|---|---|
| 976 134 | 3/1963 | Germany . |
| 2096577 | 10/1982 | United Kingdom . |

*Primary Examiner*—William E. Terrell
*Assistant Examiner*—Patrick Mackey
*Attorney, Agent, or Firm*—Herbert L. Lerner; Laurence A. Greenberg

[57] ABSTRACT

Device for cyclically lifting and lowering at least one lifting sucker in a feeder of a sheet-processing machine, wherein a sheet lifted by the lifting sucker is transferred to at least one pull sucker for further transport, the lifting sucker being operatively connected by a lifting-sucker transmission to a cyclically controlled drive, the lifting-sucker transmission including a coupler having a joint steplessly bringable onto various cam paths in accordance with a selective suction position of the lifting sucker, all of the cam paths having a common intersecting point.

4 Claims, 3 Drawing Sheets

11
35
19
21
9
22
26
8
24
7
18
17
4
13
12
16
20
6
14
23
31
33
2
34
32
27
28
1
29
3

DEVICE FOR CYCLICALLY LIFTING AND LOWERING A LIFTING SUCKER IN A FEEDER OF A SHEET-PROCESSING MACHINE

BACKGROUND OF THE INVENTION

Field of the Invention

The invention relates to a device for cyclically lifting and lowering a lifting sucker in a feeder of a sheet-processing machine and, more particularly, to such a device having equipment for adjusting the suction level.

It has become known heretofore from German Patent 976 134 to provide an adjusting device on a lifting-sucker transmission which permits the adjustment of spacing provided between an upper side of a sheet and a lifting sucker in suction position. The suction level must be adjustable particularly when processing printing stock of various thickness, for example, from onionskin or light-weight paper up to cardboard or pasteboard. In the case of book paper or light-weight paper, the spacing must be relatively large so that a sucking-through and sucking together of double sheets is prevented. The spacing must be relatively small for heavy cardboard so that the suction force is great enough to reliably suck up the cardboard.

In the aforementioned German Patent 976 134, a lifting-sucker transmission is provided for adjusting the spacing between a sheet pile and a lifting sucker, the lifting-sucker transmission having an eccentric adjusting device for varying an angle between a roller lever and an operating lever.

A change in the suction level, in the case of this German patent also, however causes a disadvantageous change in a transfer position from the lifting sucker to a pull sucker arranged downstream from the lifting sucker. This measure can consequently transport and transfer problems, respectively, if the lifting sucker and the pull sucker are located near one another.

SUMMARY OF THE INVENTION

It is accordingly an object of the invention to provide a device for cyclically lifting and lowering a lifting sucker in a feeder of a sheet-processing machine with a lifting-sucker drive which steplessly or infinitely adjusts the suction position of the lifting sucker without varying a transfer position.

With the foregoing and other objects in view, there is provided, in accordance with the invention, a device for cyclically lifting and lowering at least one lifting sucker in a feeder of a sheet-processing machine, wherein a sheet lifted by the lifting sucker is transferred to at least one pull sucker for further transport, the lifting sucker being operatively connected by a lifting-sucker transmission to a cyclically controlled drive, the lifting-sucker transmission comprising a coupler having a joint steplessly bringable onto various cam paths in accordance with a selective suction position of the lifting sucker, all of the cam paths having a common intersecting point.

In accordance with another feature of the invention, the common intersecting point is a location at which a sheet is transferred from the lifting sucker to the pull sucker.

In accordance with a further feature of the invention, the device includes a stationarily disposed adjusting device.

In accordance with an added feature of the invention, the adjusting device is provided with indicia.

In accordance with an additional feature of the invention, the coupler has a radius determining the cam paths.

In accordance with a concomitant feature of the invention, the lifting and lowering device includes a guide roller, and a guide rod for guiding the guide roller, the guide rod being mounted so as to be swivelable about a center line distinguishing a location at which the sheet is transferred from the lifting sucker to the pull sucker.

An advantage of the device according to the invention is the stationary disposition of the adjusting device. Due to this feature, it is possible to adjust the spacing of the lifting sucker from the upper side of a sheet even during operation.

Advantageously, an articulating joint of a coupler producing the lifting stroke of the lifting sucker is provided to travel out on various travel paths, the joint being directly mounted on the adjusting device.

In a further construction of the device according to the invention, a guiding element, for example, a guide bar, is provided for the joint, the guide bar being mounted so as to be swivelable by means of an adjusting device about a bearing location fixed to a stationary frame. The bearing location simultaneously distinguishes or corresponds to the sheet transfer location.

DESCRIPTION OF THE PREFERRED EMBODIMENTS

Figure 1:
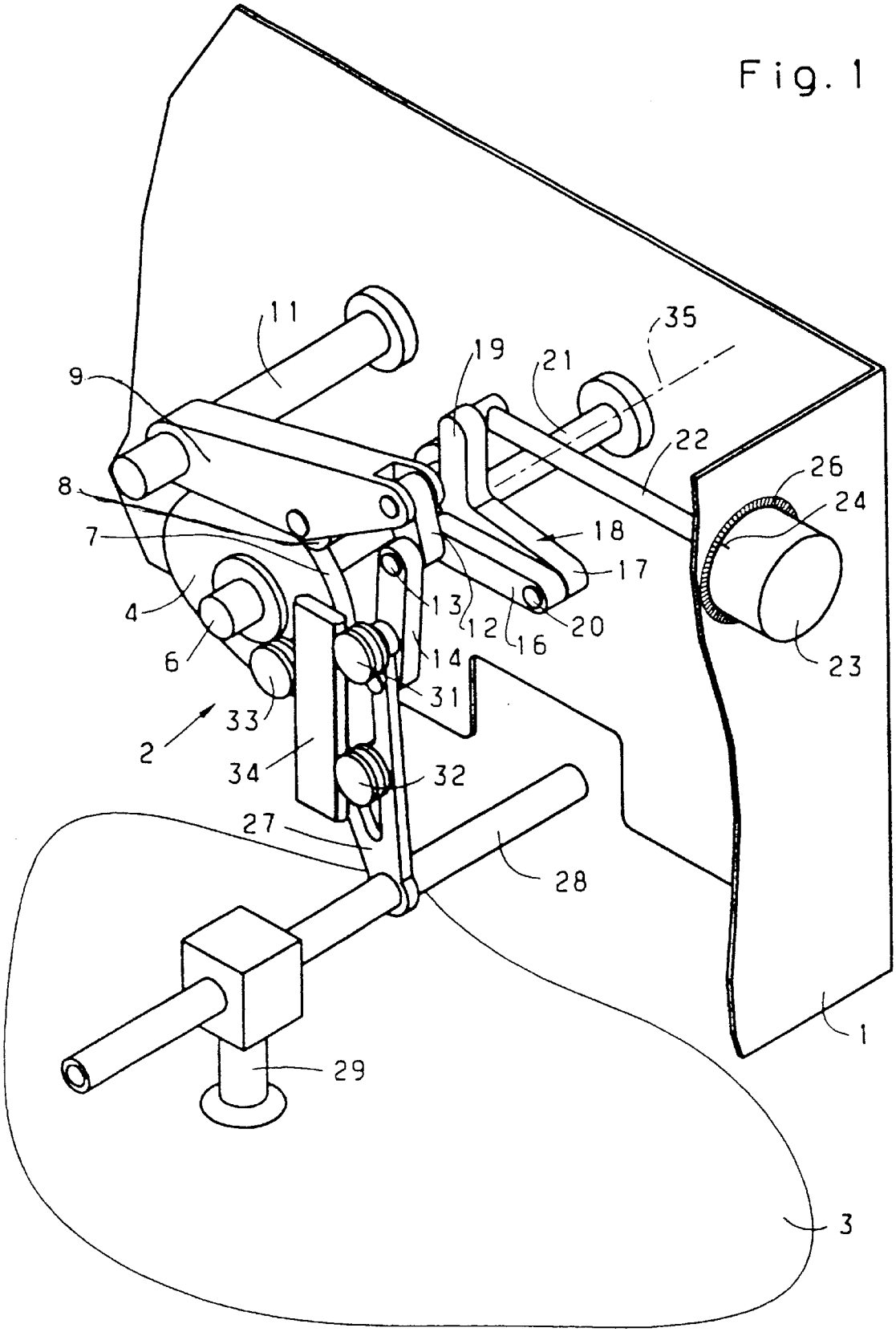
FIG. 1 is a partly broken away perspective view of the device according to the invention.

Referring now to the drawings and, first, particularly to FIG. 1 thereof, there is shown therein a housing 1 for a lifting sucker transmission 2 disposed above a sheet pile 3 and provided with a cam plate or control disc 4 driven with the operating-cycle frequency of a sheet feeder. The control or cam disc 4 sits on a shaft 6, fixed against rotation relative thereto, the shaft 6 being mounted so as to be rotatably drivable in the housing 1. A cam side 7 of the control disc 4 is in rolling contact with a control roller 8 which is rotatably supported or journaled on a horizontally disposed roller lever 9. A non-illustrated spring is fastened at one end to the roller lever 9 and at the other end to the housing 1 and ensures that the control roller 8 is always in rolling contact with the cam side 7 of the control disc 4.

A first end of the roller lever 9 is journaled or swivelably supported on a shaft 11 which is fastened to the housing 1. A downwardly directed coupler 12 is articulatingly connected or linked by a first end thereof to a second end of the roller lever 9. Respective further couplers 14 and 16 are articulatingly linked by respective first ends thereof to a second end of the coupler 12. The couplers 12, 14 and 16 are mounted so a to be swivelable independently of one another about a pin 13. The coupler 16 is horizontally disposed and is articulatingly connected at an articulating joint 20 by the second end of the coupler 16 to an arm 17 of a double-arm or bellcrank adjusting lever 18 disposed substantially parallel to the coupler 16. The second arm 19 of the adjusting lever 18 is disposed at right angles to the first arm 17 thereof. The adjusting lever 18 is swivelably mounted or journaled at the intersection of the arms 17 and 19 thereof on a shaft 21 which is fastened to the housing 1. A substantially axially displaceable adjusting shaft 22 articulatingly engages with one end of the upwardly directed arm 19. An adjusting knob 23 located at an end of the adjusting shaft 22 is disposed outside the housing 1. A mark 24 on the adjusting knob 23 serves as an optical indicator of a standard or reference gauge such as a scale 26 applied to the outer wall of the housing 1.

A sucker carrier 27 is linked to a second end of the downwardly directed coupler 14. The sucker carrier 27 supports a tubular traverse 28 at an end of the sucker carrier 27 directed away from the coupler 14, a lifting sucker 29 being carried by the traverse 28. The sucker carrier 27 has three mutually spaced-apart, rotatably supported or journaled guide rollers 31, 32 and 33 which, for achieving a vertical movement, are in operating contact with a vertically disposed guide bar 34 fixed to the housing 1. In this regard, the rollers 31 and 32 are disposed on a hypothetical vertical.

The third roller 33 is disposed laterally of the hypothetical vertical, so that the rollers 31, 32 and 33 form corner points of a hypothetical triangle.

The pin 13 of the articulating connection of the couplers 12, 14 and 16 lies in a sheet transfer position on a common hypothetical straight line which coincidentally is the center line of the shaft 21. The so-called "sheet transfer position" defines the location of the lifting sucker 29 to at least one pull sucker 36 disposed at the same level or height above the sheet pile 3 and to which a sheet, which has been lifted by the lifting sucker 29 from the sheet pile 3 for further transport to the sheet processing machine, is transferred.

A "suction position" defines the location of the lifting sucker 29 which is assumed thereby at the takeover or transfer of a sheet from the sheet pile 3. In this regard, the lifting sucker 29 is located at a spacing a (a=approx. 0 to 15 mm) from the surface of the sheet pile 3. A stroke s (note FIG. 2) of the lifting sucker 29 from the "suction position" to the "transfer or takeover position" has a value s=approx. 13 to 28 mm, depending upon the adjusted spacing a.

A swiveling movement of the roller lever 9 cyclically excited by the contour of the control disc 4 takes place about the shaft 11. The articulating connection (the pin 13) is urged onto a cam path K (note FIG. 2) by the couplers 12 and 16.

The cam path K has a starting point on the hypothetical center line 35 (corresponding to the sheet transfer or takeover position) and extends in a radius $r_1$=the length of the coupler 16 about the common articulating point 20 of the coupler 16 and the adjusting lever 18. The position of this articulating point 20 is adjustable with the adjusting knob 23 by swiveling the adjusting lever 18. In this regard, an adjustment is effected by swiveling the articulating point 20 in a radius $r_2$=$r_1$=the length of the lever arm 18 about the hypothetical center line 35. With this adjustment, a new cam path $K_n$, is set which has, respectively, the same starting point (corresponding to the transfer or takeover position).

Through the various adjustable spacings of the cam paths K,$K_n$, to the lifting sucker 29, the stroke s and the consequent spacing a are steplessly or infinitely adjustable.

Figure 2:
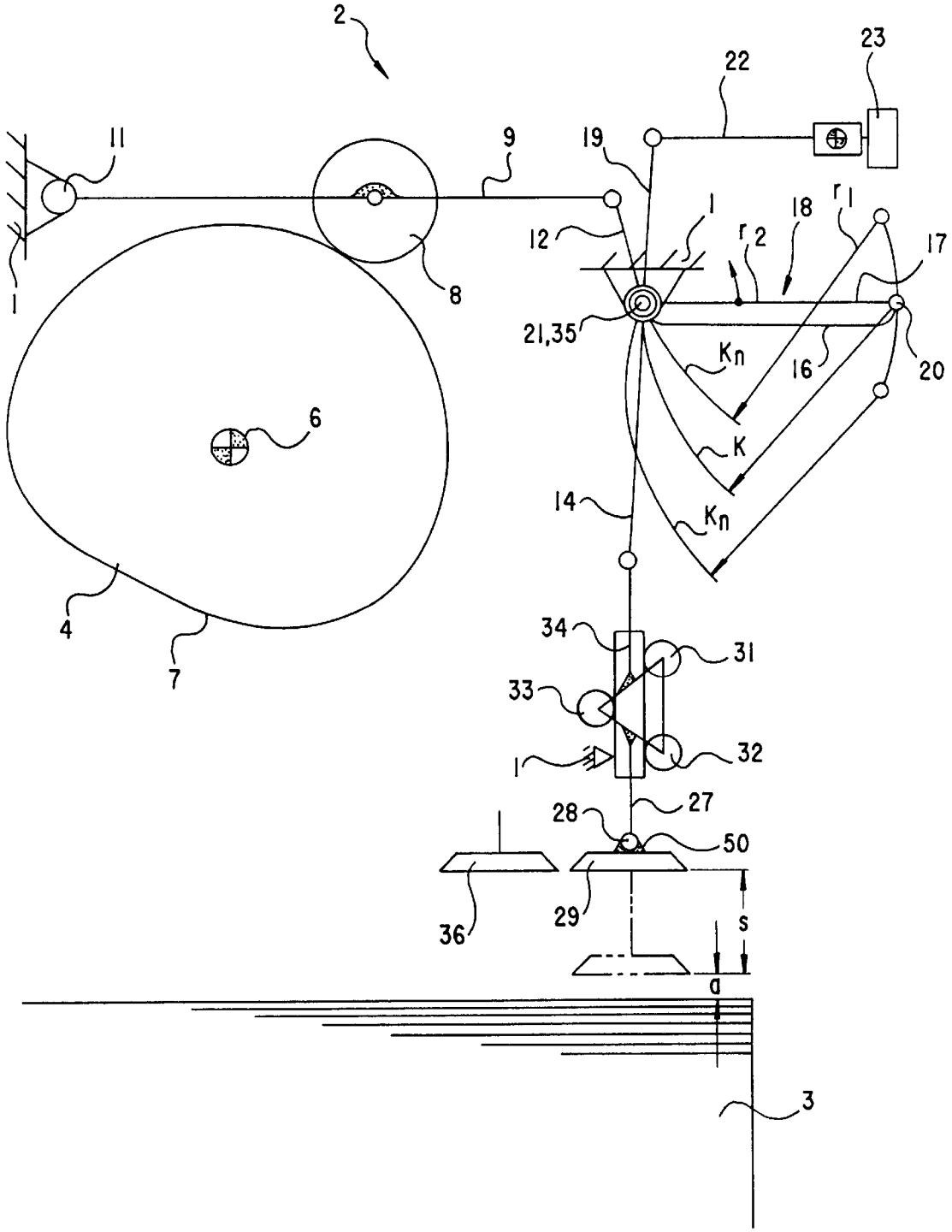
FIG. 2 is a diagrammatic and schematic side elevational view of the device according to the invention.

As shown in FIG. 2, hollow welds 50 are used to attach the tubular traverse 28 to the lifting sucker 29, thereby rigidly connecting the sucker carrier 27 to the lifting sucker 29.

Figure 3:
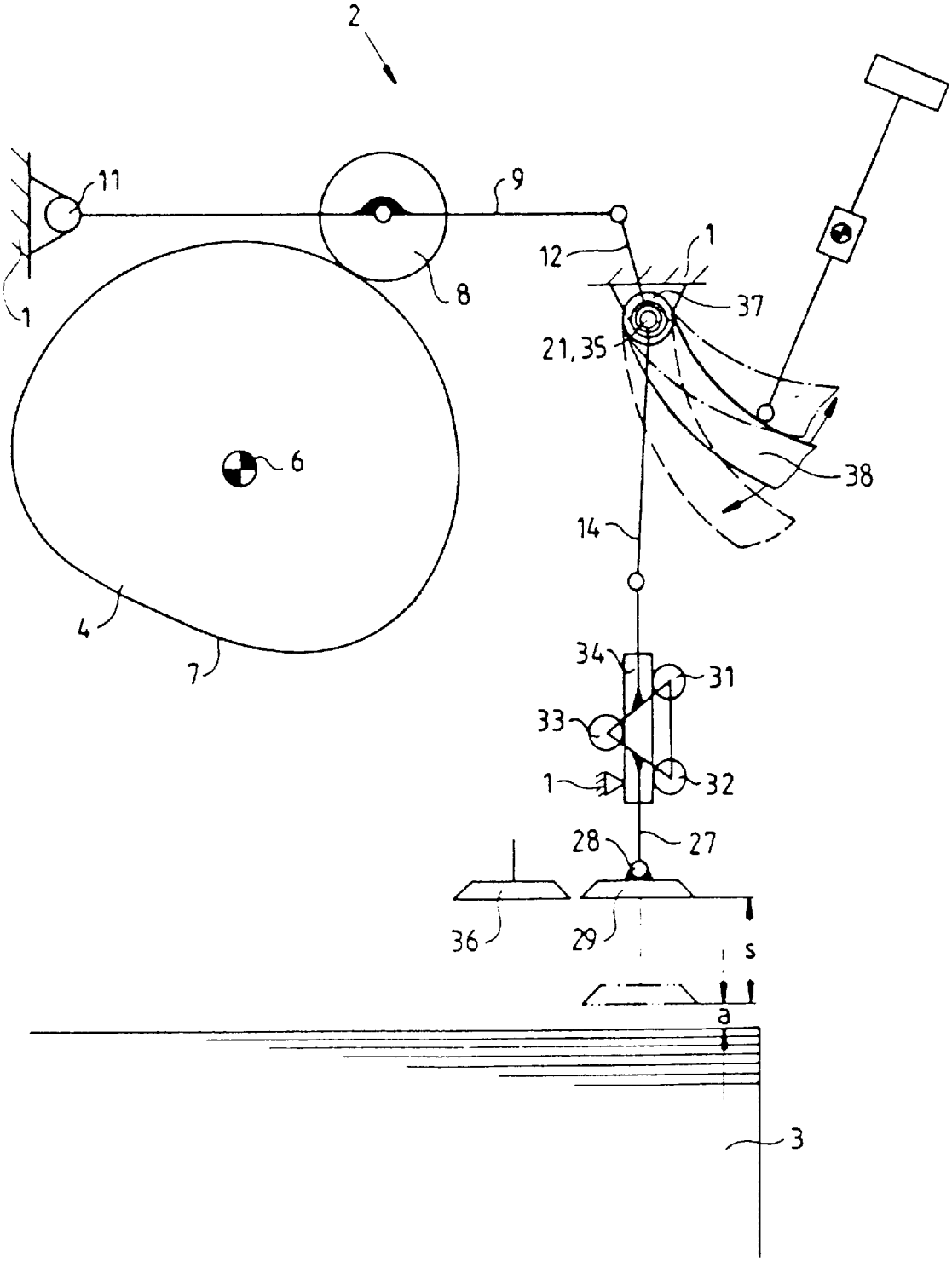
FIG. 3 is a view like that of FIG. 2 of another embodiment of the device according to the invention.

In a second embodiment of the device according to the invention, as shown in FIG. 3, a guide roller 37 is provided instead of the coupler 16. The guide roller 37 is seated rotatably on the pin 13 and is in guiding contact with a swivelably mounted or journaled guide bar 38. The guide bar 38 has a swivel point lies on or in the direct vicinity of the center line 35, so that the guide roller 37 lies in the sheet transfer or takeover position on the center line 35. Depending upon the respective desired stroke characteristic, the guide bar 38 may have a straight or curved course.

We claim:

1. An assembly for cyclically lifting sheets in a feeder of a sheet-processing machine, comprising:

at least one lifting sucker moveable to a plurality of suction positions for lifting and transferring a sheet to at least one pull sucker for further transport;

a lifting-sucker transmission including a vertically guided sucker carrier rigidly connected to said at least one lifting sucker;

a cyclically controlled drive connected to said lifting-sucker transmission for cyclically lifting and lowering said at least one lifting sucker;

said lifting-sucker transmission including a coupler having a joint steplessly bringable onto various cam paths, each one of said cam paths having a respective radius for selecting one of said plurality of suction positions, all of said cam paths having a common intersecting point, said common intersecting point is a location directly above a point at which a sheet is transferred from the lifting sucker to the pull sucker.

2. The assembly according to claim 1, wherein said lifting sucker transmission further includes a stationarily disposed adjusting device selecting between said plurality of suction positions.

3. The assembly according to claim 2, wherein said adjusting device is provided with indicia.

4. The assembly according to claim 1, including a guide roller, and a guide rod for guiding said guide roller, said guide rod being mounted so as to be swivelable about a center line distinguishing a location at which the sheet is transferred from said lifting sucker to the pull sucker.

* * * * *